US009711863B2

(12) United States Patent
De Luis et al.

(10) Patent No.: US 9,711,863 B2
(45) Date of Patent: Jul. 18, 2017

(54) DUAL BAND WLAN COUPLED RADIATOR ANTENNA

(71) Applicants: Javier Rodriguez De Luis, Kirkland, WA (US); Alireza Mahanfar, Bellevue, WA (US); Benjamin Shewan, Redmond, WA (US)

(72) Inventors: Javier Rodriguez De Luis, Kirkland, WA (US); Alireza Mahanfar, Bellevue, WA (US); Benjamin Shewan, Redmond, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 277 days.

(21) Appl. No.: 13/801,302

(22) Filed: Mar. 13, 2013

(65) Prior Publication Data

US 2014/0266917 A1 Sep. 18, 2014

(51) Int. Cl.
*H01Q 9/04* (2006.01)
*H01Q 5/00* (2015.01)
(Continued)

(52) U.S. Cl.
CPC ..... *H01Q 19/005* (2013.01); *H01Q 1/38* (2013.01); *H01Q 5/385* (2015.01); *H01Q 9/0407* (2013.01); *H01Q 9/40* (2013.01)

(58) Field of Classification Search
CPC ..... H01Q 1/2258–1/246; H01Q 1/38; H01Q 5/00; H01Q 5/30; H01Q 5/307; H01Q 5/314; H01Q 5/321; H01Q 5/328; H01Q 5/335; H01Q 5/342; H01Q 5/35; H01Q 5/357; H01Q 5/364; H01Q 5/371;
(Continued)

(56) References Cited

U.S. PATENT DOCUMENTS 3,978,487 A * 8/1976 Kaloi ..... 343/829
5,852,421 A 12/1998 Maldonado
(Continued)

FOREIGN PATENT DOCUMENTS

CN 1501548 A 6/2004
EP 1359639 A1 11/2003
(Continued)

OTHER PUBLICATIONS

Chen, et al., "Printed Monopole Antenna for 2.4/5.2 GHz Dual-band Operation", In Proceeding of IEEE Antennas and Propagation Society International Symposium, Jun. 22, 2003, 4 pages.
(Continued)

*Primary Examiner* — Tho G Phan
*Assistant Examiner* — Patrick Holecek
(74) *Attorney, Agent, or Firm* — Klarquist Sparkman, LLP

(57) ABSTRACT

Planar antennas comprise capacitively coupled antenna patches. A first antenna patch configured to radiate in a first frequency band is coupled to a transmitter/receiver. The first antenna patch is situated to capacitively couple radiation in the first frequency band and a second frequency band to second and third antenna patches, respectively. The first and second antenna patches extend antenna bandwidth in the first frequency band, and the third antenna patch is bent so that the antenna patches can be situated in a predetermined substrate area.

14 Claims, 9 Drawing Sheets

(51) Int. Cl.

| | |
|---|---|
| ***H01Q 19/00*** | (2006.01) |
| ***H01Q 1/38*** | (2006.01) |
| ***H01Q 9/40*** | (2006.01) |
| ***H01Q 5/385*** | (2015.01) |

(58) Field of Classification Search
CPC ..... H01Q 5/378; H01Q 5/385; H01Q 5/392; H01Q 5/40; H01Q 5/42; H01Q 9/005; H01Q 9/04–9/0478; H01Q 19/005; H01Q 19/26; H01Q 19/32; H01Q 9/30; H01Q 9/40; H01Q 21/0075; H01Q 21/30
USPC ..... 343/702, 700 MS; 102/702, 700 MS
See application file for complete search history.

(56) References Cited

U.S. PATENT DOCUMENTS

| | | | | |
|---|---|---|---|---|
| 6,028,555 | A | 2/2000 | Harano | |
| 6,535,170 | B2 | 3/2003 | Sawamura et al. | |
| 6,624,788 | B2 | 9/2003 | Boyle | |
| 6,646,610 | B2 | 11/2003 | Troelsen | |
| 6,720,925 | B2 | 4/2004 | Wong et al. | |
| 6,727,852 | B2 | 4/2004 | Cheng | |
| 6,738,023 | B2 | 5/2004 | Scott et al. | |
| 6,839,040 | B2 | 1/2005 | Huber et al. | |
| 6,980,154 | B2 | 12/2005 | Vance et al. | |
| 7,113,135 | B2 | 9/2006 | Jo et al. | |
| 7,167,130 | B2 | 1/2007 | Hayes | |
| 7,233,289 | B2 * | 6/2007 | Chung | H01Q 1/38 343/700 MS |
| 7,345,637 | B2 | 3/2008 | Mizoguchi et al. | |
| 7,616,158 | B2 * | 11/2009 | Mak et al. | 343/700 MS |
| 7,667,663 | B2 * | 2/2010 | Hsiao | H01Q 1/38 343/700 MS |
| 7,952,529 | B2 | 5/2011 | Huang et al. | |
| 7,978,141 | B2 * | 7/2011 | Chi | H01Q 1/243 343/700 MS |
| 8,077,097 | B2 | 12/2011 | Chung et al. | |
| 8,144,060 | B2 | 3/2012 | Angell et al. | |
| 2002/0163470 | A1 | 11/2002 | Nagumo et al. | |
| 2003/0045324 | A1 * | 3/2003 | Nagumo | H01Q 1/243 455/550.1 |
| 2003/0103010 | A1 | 6/2003 | Boyle | |
| 2007/0273606 | A1 | 11/2007 | Mak et al. | |
| 2009/0128426 | A1 | 5/2009 | Wang et al. | |
| 2009/0267844 | A1 | 10/2009 | Lin | |
| 2011/0193752 | A1 | 8/2011 | Wang et al. | |
| 2014/0062794 | A1 * | 3/2014 | Guo et al. | 343/700 MS |

FOREIGN PATENT DOCUMENTS

| | | | |
|---|---|---|---|
| EP | 2645477 | A1 | 10/2013 |
| WO | 2012/068947 | A1 | 5/2012 |

OTHER PUBLICATIONS

Rathore, et al., "Compact Dual-Band (2.4/5.2GHz) Monopole Antenna for WLAN Applications", In Proceedings of International Workshop on Antenna Technology, Mar. 1, 2010, 4 pages.

Sharma, et al., "Dual Band Microstrip Patch Antenna Using Dual Feed for Wireless Applications", Retrieved on: Nov. 14, 2012, Available at: http://www.ijecse.org/wp-content/uploads/2012/08/Volume-1Number-2PP-230-238.pdf.

Kuo, et al., "Printed Double-T Monopole Antenna for 2.4/5.2 GHz Dual-Band WLAN Operations", In Proceedings og IEEE Transactions on Antennas and Propagation, vol. 51, No. 9, Sep. 2003, 6 pages.

Ahuja, Neha, "Study and Investigations on Various Microstrip Patch Antennas for Wireless Applications", Retrieved on: Nov. 14, 2012, Available at: http://dspace.thapar.edu:8080/dspace/bitstream/10266/1783/1/thesis.pdf.

Chitra, et al., "Design of Double L-Slot Microstrip Patch Antenna for WiMAX and WLAN Application", In Proceedings of International Conference on Computing, Communication and Applications, Feb. 22, 2012, 4 pages.

Yanagi et al., "A Planar UWB Monopole Antenna Formed on a Printed Circuit Board," downloaded Nov. 25, 2012.

International Search Report and Written Opinion for International Application No. PCT/US2014/018404, dated May 8, 2014, 12 Pages.

International Preliminary Report on Patentability from related International Patent Application PCT/US2014/018404, dated Feb. 17, 2015, 17 pages.

"First Office Action & Search Report Issued in Chinese Patent Application No. 201480015137.2", Mailed Date: Jan. 25, 2017, 14 Pages.

* cited by examiner

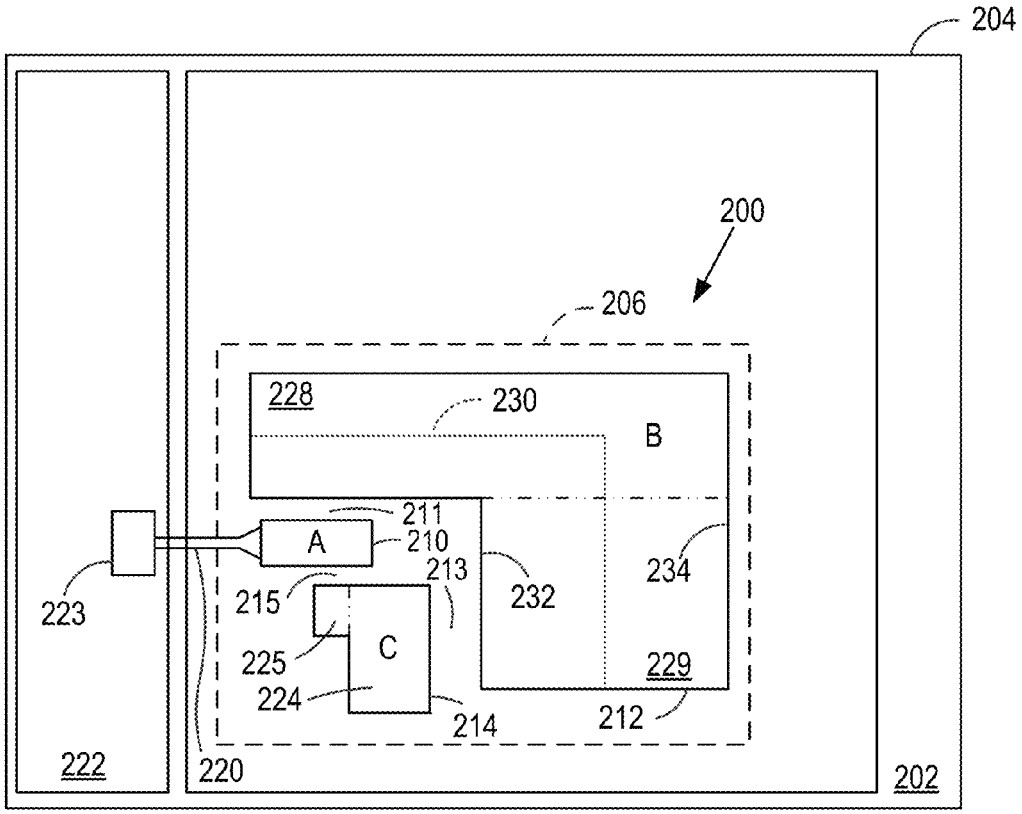
FIG. 2
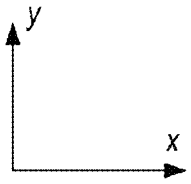

DUAL BAND WLAN COUPLED RADIATOR ANTENNA

FIELD

The disclosure pertains to dual band antennas for communication in wireless networks.

BACKGROUND

Wireless LAN networks (commonly known as WiFi networks) are extensively used throughout the world for providing users with access to services and/or internet connectivity through standards contained in IEEE 802.11. These standards use radio frequencies in the industrial, scientific and medical (ISM) radio bands. For most countries, the channels in these bands are located between 2.41 GHz and 2.48 GHz (denoted here as the 2.4 GHz band) or between 5.17 GHz and 5.82 GHz (denoted here as the 5 GHz band). Wireless LANs typically are based on one or both of these frequency bands, and network devices are generally required to transmit and receive in both bands, requiring dual band antennas, complicating antenna design.

SUMMARY

The Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Disclosed herein are representative microstrip antennas that preferentially direct radiated energy towards an end user location, have low profiles, and are conveniently implemented with other circuit elements on a PCB. The disclosed antennas do not require additional materials that tend to increase system cost or use a device chassis as a ground plane.

Disclosed herein are representative multiband antennas that can operate effectively simultaneously at two or more frequency bands. In some examples, the antennas are configured to operate on two bands such as wireless networking bands near 2.4 GHz and 5.0 GHz. Representative antennas are based on dual band microstrip or patch configurations and have directional radiation patterns that can be directed toward an anticipated location of a user mobile device or other device with which communication is intended. Such dual band antennas can provide broad frequency bandwidth based on a broadband coupling mechanism involving multiple radiators. In some examples, such antennas can be mounted on top of a device chassis and can be formed on a planar PCB that includes other device circuitry.

Dual band antennas comprise a dielectric substrate and first, second, and third conductors defined on a first surface of the dielectric substrate in an antenna area. The second and the third conductors are spaced apart from the first conductor and are capacitively coupled to the first conductor. A transmission line is in electrical contact with the first conductor and configured to communicate a radio frequency electrical signal to the first conductor. The first conductor is selected so as to correspond to about ¼ wavelength at a first frequency in a first frequency band, the second conductor is selected so as to correspond to about ½ wavelength at a frequency in a second frequency band, and the third conductor is selected to correspond to about ½ wavelength at a second frequency in the first frequency band. In some examples, the first conductor is rectangular, and a length of the first conductor corresponds to about ½ wavelength at the first frequency. In representative embodiments, an effective length of the second conductor corresponds to the half wavelength at the frequency in the second frequency band. In other examples, an effective length of the third conductor corresponds to about ½ wavelength at the second frequency in the first frequency band. In still further examples, the first frequency and the second frequency in the first frequency band are different frequencies. In some embodiments, the second conductor is a bent rectangle having an effective length that corresponds to about ¼ wavelength at the frequency in the second frequency band. In other alternatives, the substrate includes a second surface opposite the first surface, and an area of the second surface corresponding to the antenna area is substantially non-conductive.

In some examples, the first, second and third conductors are configured to preferentially radiate RF power in response to an applied RF signal away from the second surface of the substrate, and the first frequency band is at about 5-6 GHz and the second frequency band is at about 2-3 GHz.

Methods comprise coupling RF power in first and second frequency bands to a first antenna section, configured to radiate RF power in the first frequency band. The RF power in at least the first frequency band is capacitively coupled to a second antenna section configured to radiate RF power in the first frequency band. The RF power in at least the second frequency band is capacitively coupled to a third antenna section configured to radiate RF power in the second frequency band. In further examples, the RF power in at least the first frequency band is capacitively coupled to the second antenna section from the first antenna section or the RF power in at least the second frequency band is capacitively coupled to the third antenna section from the first antenna section. In typical examples, the first, second, and third antenna sections are configured as patch antenna sections and the first and second antenna sections have different peak radiation frequencies in the first frequency band. In one example, the first frequency band is at about 5-6 GHz and the second frequency band is at about 2-3 GHz. In typical examples, the first antenna section is a quarter wavelength antenna section and the second and third antenna sections are half wavelength antenna sections.

Wireless networking apparatus include a transceiver and an antenna secured to a substrate. The transceiver is configured to receive RF signals from the antenna and couple RF signals to the antenna. The antenna comprises a plurality of patch antenna sections, wherein at least one patch antenna section is capacitively coupled to a patch antenna section that is directly coupled to the transceiver. In some examples, the antenna is configured to transmit and receive radiation preferentially from a selected side of the substrate. In typical examples, at least two of the patch antenna sections are configured for wireless communication in a first frequency band, and at least one antenna section is configured to radiate in a second frequency band, wherein the first frequency band is at about 5-6 GHz and the second frequency band is at about 2-3 GHz.

The foregoing and other features and advantages of the disclosed technology will become more apparent from the following detailed description, which proceeds with reference to the accompanying figures.

BRIEF DESCRIPTION OF THE DRAWINGS

FIG. 2 illustrates a dual band antenna with two L-shaped antenna conductors.

DETAILED DESCRIPTION

Figure 1A:
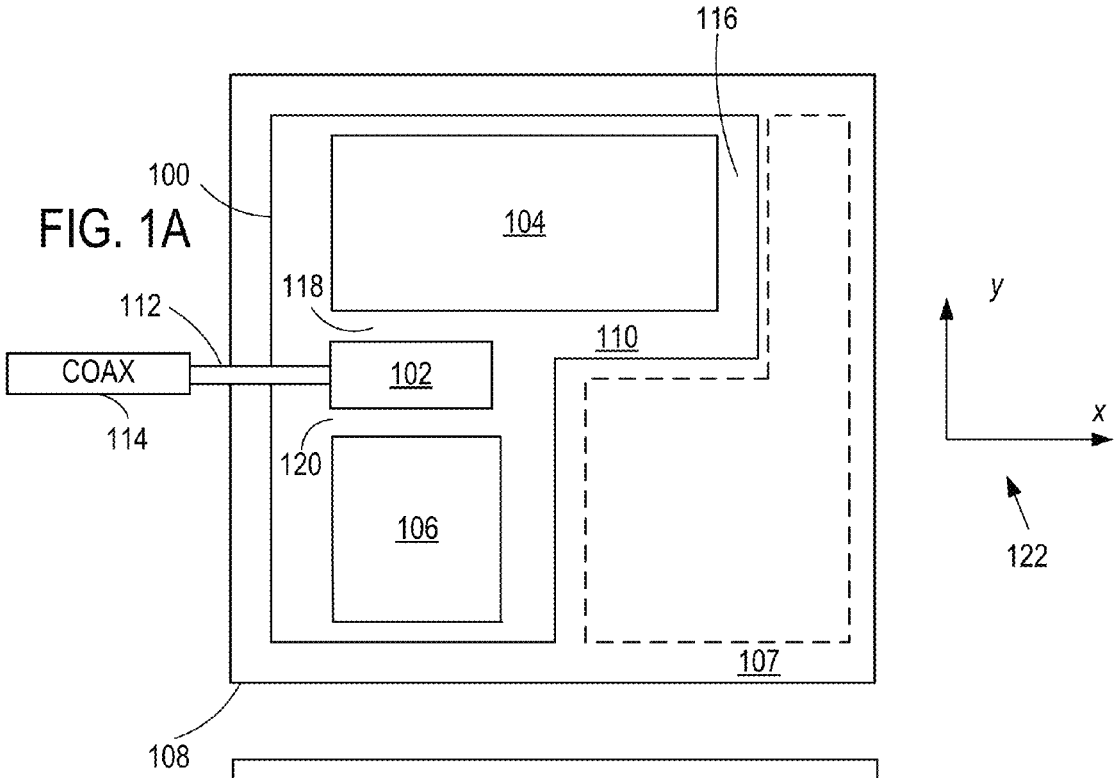
FIGS. 1A-1B illustrate opposing surfaces of a substrate on which a dual band antenna is defined.

As used in this application and in the claims, the singular forms "a," "an," and "the" include the plural forms unless the context clearly dictates otherwise. Additionally, the term "includes" means "comprises." Further, the term "coupled" does not exclude the presence of intermediate elements between the coupled items.

The systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present or problems be solved. Any theories of operation are to facilitate explanation, but the disclosed systems, methods, and apparatus are not limited to such theories of operation.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed systems, methods, and apparatus can be used in conjunction with other systems, methods, and apparatus. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

In some examples, values, procedures, or apparatus are referred to as "lowest," "best," "minimum," or the like. It will be appreciated that such descriptions are intended to indicate that a selection among many used functional alternatives can be made, and such selections need not be better, smaller, or otherwise preferable to other selections.

Some disclosed examples pertain to antennas configured for use in wireless networks based on IEEE 802.11 standards. Such networks use radiofrequencies in a first frequency band extending from 2.412 GHz to 2.484 GHz and a second frequency band extending from 5.170 GHz to 5.825 GHz. For convenience in the following description, radiofrequency electromagnetic radiation is referred to as being associated with a selected frequency and includes a frequency band about the selected frequency. Antennas are disclosed that are defined on dielectric substrates so that radiation wavelength is dependent on the radiofrequency dielectric constant of the substrate. This wavelength is shorter than a free space wavelength.

Disclosed below are representative capacitively coupled radiators, typically defined in a square or rectangular "keepout" area of a circuit substrate. Typically, a substrate area lacking a ground plane or other ground connections is referred to as a keepout area. In typical antennas, a keepout area corresponds to the antenna area, but can be larger or smaller if desired. In this way, antenna sections are distant from a ground conductor. In some examples, a transmission line is coupled to a first patch radiator configured to be a ¼ wavelength radiator in a first frequency band. Adjacent the first patch radiator (the "feed" patch) and spaced apart, L-shaped or rectangular second and third patch radiators are defined. The second patch radiator is a half wavelength radiator in the first frequency band. The third patch radiator is a half wavelength radiator in a second frequency band. The second and third patch radiators are capacitively coupled to the first patch radiator. The first and second patch radiators establish a radiation bandwidth in a first frequency band, while the third patch radiator establishes a typically narrower radiation bandwidth at a second frequency band. In some wireless network applications, the first and second frequency bands are at frequencies of about 5 GHz and 2.4 GHz. The combined patch radiators can be impedance matched to 50 ohms. Direct electrical connection via a transmission line is made to a patch radiator configured for a higher frequency rather than a lower frequency, but in other examples, direct connection is made to a lower frequency patch radiator.

For use in this description, radio frequency (RF) refers to frequencies between about 50 MHz and 10 GHz. Rectangular conductors are referred to as having a length and a width, and as used herein, a length is a longer of rectangle edge dimensions. Electromagnetic wavelength in a propagation media consisting of a certain material depends on a local dielectric constant, and wavelength refers to either free space wavelength (if vacuum material is considered) or guided or effective wavelength (if different materials are present). An effective length of a non-square conductor is a length along a center of the conductor. Effective conductor lengths can also vary due to fringing fields at conductor edges. Such fringing fields generally tend to make conductors appear electrically longer as the fringing fields extend beyond the actual conductor lengths. In some examples, rectangular antenna conductors are provided with relatively smaller area conductor sections that permit antenna tuning. Connections to antennas or antenna sections are described herein as being made with transmission lines such as striplines, slotlines, coplanar waveguides, other planar or non-planar waveguides, or coaxial cables.

Some applications of the disclosed antenna systems and methods are directed to wireless networking. The dual band nature of wireless networks typically requires the use of dual band antennas that can transmit and receive over frequency bands at about 2.5 GHz and 5 GHz. In addition, in some applications, a wireless device position relative to a user can be predicted, and directional radiation patterns may be useful. Directional antennas can provide superior RF signal strength at user locations and provide superior reception of RF signals generated by a user device. Directional antennas can permit reduced power consumption and increase battery life. Selecting a particular radiation pattern can therefore improve link power budget and reduce unwanted radiation and interference received by other devices.

Referring to FIG. 1, a dual band antenna includes a first antenna section 102, a second antenna section 104, and a third antenna section 106 defined as conductive areas on a first surface 107 of a substrate 108. The substrate 108 can be formed of a variety of rigid or flexible dielectric materials. For example, printed circuit board (PCB) materials such as glass-reinforced epoxy laminate sheets such as those designated FR-4 and G-10, or other PCB materials or ceramics can be used. Flexible materials can also be used and include polyimides. With such materials, additional circuit features used to connect to the antenna 100 or to provide RF amplification, detection, modulation, demodulation, or other data receiver/transmitter functions can be defined on the substrate 108.

In a typical example, the substrate 108 is a PCB material. A ground conductor 113 used for circuit connections or component mounting can be provided on a second substrate surface 109 opposite the first surface 107. The ground conductor 113 does not extend into an antenna area 110 occupied by the antenna sections 102, 104, 106. If the substrate 108 is a multilayer substrate, portions between the first surface 107 and the second surface 109 in the antenna area 110 are generally free of ground plane or other conductors. In addition, the antenna area 110 preferably provides a gap 116 that is free of other conductors or components. A transmission line or waveguide 112 such as a microstrip, stripline, slotline, coplanar waveguide or other waveguide is coupled to a coaxial cable 114 and the antenna section 102.

The antenna sections 102, 104 are situated so that radiofrequency signals communicated from the waveguide 112 are capacitively coupled from the antenna section 102 to the antenna section 104 without a direct conductive path. Similarly, the antenna sections 102, 106 are situated so that radiofrequency signals communicated from the waveguide 112 are capacitively coupled from the antenna section 102 to the antenna section 106 without a direct conductive path. Accordingly, gaps 118, 120 are generally small and for antennas configured for use at wireless networking frequencies, gaps are typically less than 1.0 mm, 0.8 mm, 0.6 mm, 0.4 mm, or 0.2 mm but can be larger at lower frequencies. Additional antenna sections can be included as well, and can be situated so as to be directly or capacitively coupled to one of the antenna sections 102, 104, 106.

The antenna sections 102, 104, 106 are selected so as to receive and radiate signals in selected frequency ranges. The antenna section 102 can be selected to be responsive at a first frequency by selecting a dimension to correspond to about ½ or ¼ wavelength at the first frequency. For example, referring to an xy coordinate system 122, an x-dimension of the antenna section 102 can be about ½ or ¼ wavelength at the first frequency. As the antenna section 102 is defined on the substrate 108, the guided wavelength is dependent on the radiofrequency dielectric constant of the substrate 108 and is according shorter than free space wavelength.

Geometrical characteristics of the antenna sections 104, 106 can be similarly selected. For example, the antenna section 104 can be selected to have an x-dimension corresponding to ½ or ¼ wavelength at a second frequency. As illustrated in FIG. 1, the antenna section 104 is larger than the antenna sections 102, 106 and the second frequency is a lower frequency than the first frequency. For superior performance with respect to both bandwidth and radiation efficiency, the x-dimension of the antenna section 104 corresponds to ½ wavelength at the second frequency. The antenna section 106 can be selected to have x- and/or y-dimensions that correspond to ½ or ¼ wavelength at the first frequency. If the first frequency is associated with a desired frequency band, dimensions of the first antenna section 102 and the second antenna section 106 can be selected to correspond to different frequencies within or near the frequency band to provide superior antenna performance over the frequency band.

Figure 1B:
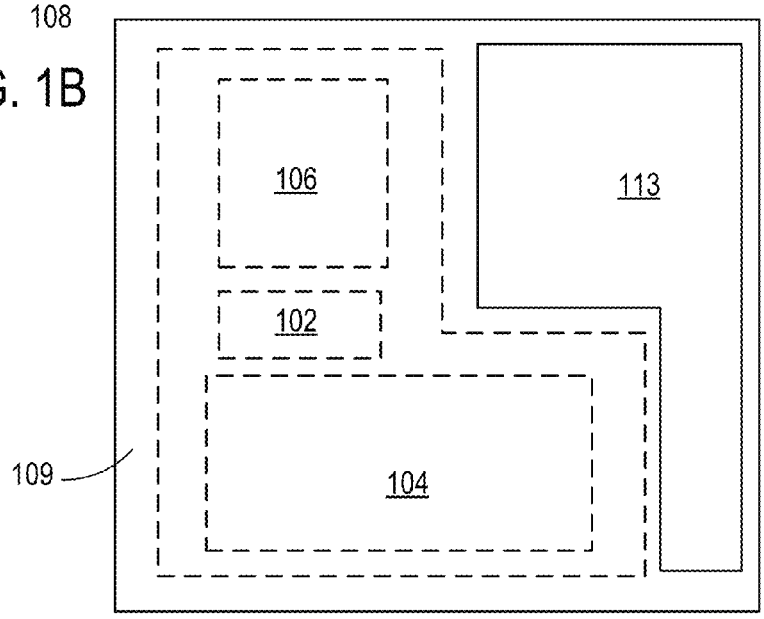

In some examples, antennas are arranged to use a more compact portion of substrate surface area, and rectangular antenna areas such as shown in FIGS. 1A-1B are not necessary. With reference to FIG. 2, a dual band antenna 200 is defined on a first surface 202 of a substrate 204 and within a keepout area 206. A second surface of the substrate, opposite the first surface 102 can include one or more dielectric layers, but opposite the keepout area 206, the second surface is generally free of conductive materials and ground plane conductors.

Antenna conductors 210, 212, 214 are situated on the surface 202 and separated by respective gaps 211, 213, 215. A microstripline 220 extends from an area 222 of the substrate 204 to the antenna conductor 210 so as to electrically contact the antenna conductor 210. As shown in FIG. 2, the microstripline 220 tapers at a connection with the antenna section 210, but other types of connections can be used including coaxial cables or waveguides defined on the substrate 204 or other substrates. An RF connector 223 is coupled to the microstripline 220 for connection to a transmitter or receiver.

The antenna section 210 is shown as a rectangular conductor, but other shapes can be used. An x-dimension of the antenna section 210 corresponds to a ¼ wavelength at a first frequency or in a first frequency band. As noted above, a ¼ wavelength is dependent on both frequency and the dielectric constant of the substrate. The antenna section 214 includes first and second rectangular portions 224, 225. Typically one or more dimensions of the rectangular portions are selected based on the first frequency or frequency band. The antenna portion 225 is a tuning portion that is configured to better match the effective antenna length to the first frequency or frequency band. In some examples, the antenna sections 210, 214 are selected have peak radiation efficiency at frequencies between about 5 GHz and 6 GHz, such as about 5.3 GHz and 5.6 GHz.

The antenna section 212 is an extended rectangular conductor selected to a dimension corresponding to ½ wavelength at a second frequency or frequency band. The antenna section 212 includes first and second rectangular portions 228, 229. A length of a central axis 230 of the antenna section 212 is selected to correspond to about ½ wavelength in the second frequency band. Lengths of an inner edge 232 and an outer edge 234 of the antenna section 214 can be selected to provide an intended bandwidth. These lengths tend to provide antenna radiation efficiency at frequencies at which these lengths correspond to ½ wavelength. Thus, narrower bandwidths are realized as these lengths are made closer to the length of the central axis 230.

Figure 3:
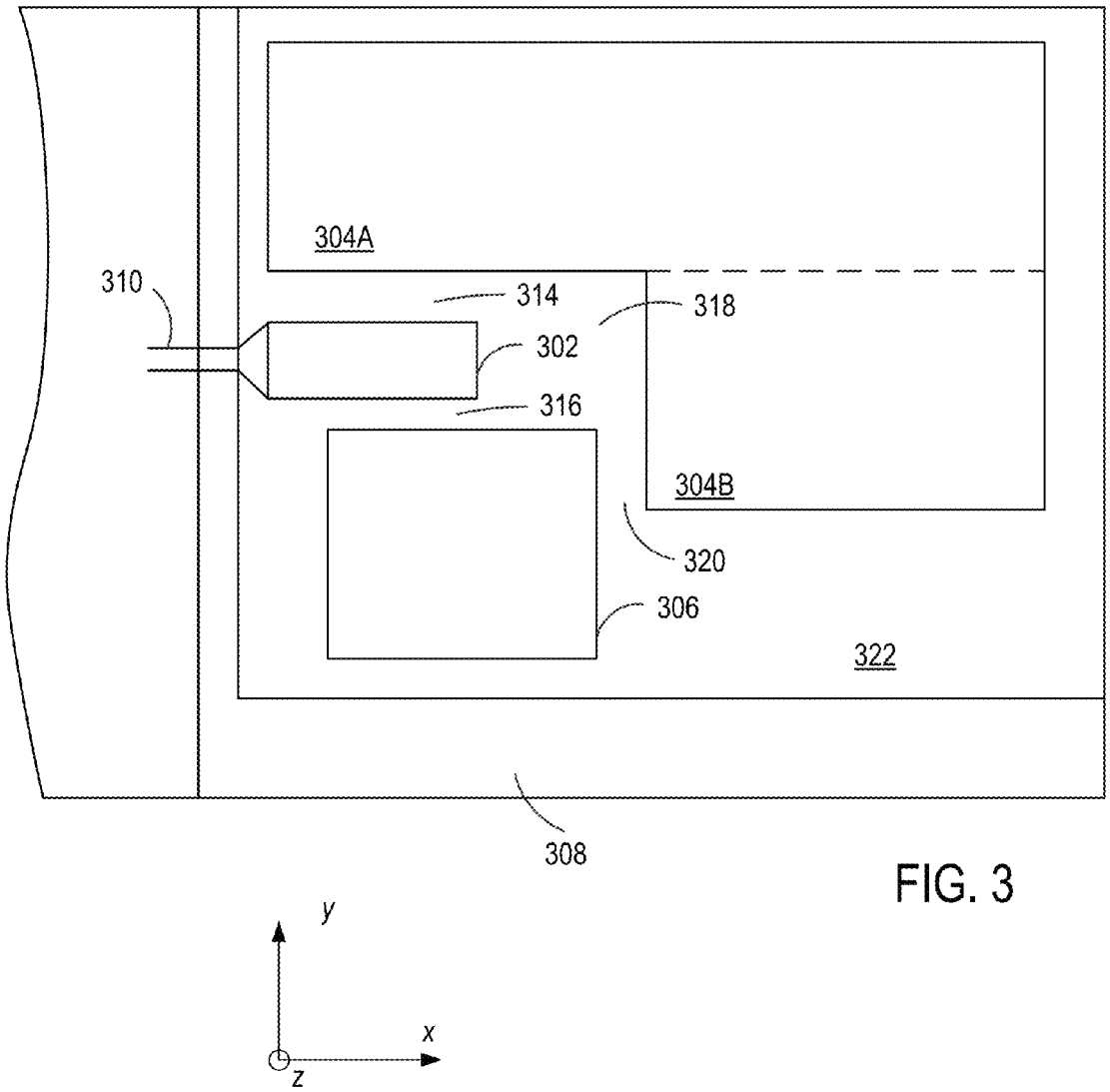
FIG. 3 illustrates a representative dual band antenna configured for use at about 2.4 GHz and 5-6 GHz.

A representative implementation of a dual band antenna for IEEE 802.11 wireless networks is illustrated in FIG. 3. Design frequency bands include a first frequency band extending from 5.170 GHz to 5.825 GHz and a second frequency band extending from 2.412 GHz to 2.484 GHz. First, second, and third antenna sections 302, 304, 306 are defined on a substrate surface 308. An input waveguide 310 is coupled to the first antenna section 302. The first and third antenna sections 302, 306 are rectangular. The second antenna section 304 is L-shaped and includes rectangular subsections 304A, 304B. The second antenna section 304 is situated at a substrate edge 312. The second and third antenna sections 304, 306 are separated in a y-direction from the first antenna section 302 with respective gaps 314, 316. Gaps 318, 320 separate the antenna section 302 from the antenna sections 304, 306 in an x-direction. Antenna section dimensions and gaps are summarized in Tables 1-2 below. In other examples, dimensions can be greater or smaller by 50%, 20%, 10%, or 5%. An area 322 in which the antenna sections are defined generally lacks a back side ground plane, and antenna sections are typically displaced by at least about 0.5 mm, 1.0 mm, 1.5 mm, 2 mm, or 5 mm from ground conductors on either side of the substrate 308. In some examples, a ground conductor has a void that is slightly larger than an area associated with the antenna sections.

TABLE 1

Antenna Section Dimensions

| Antenna Section/Subsection | x-dimension (mm) | y-dimension (mm) |
|---|---|---|
| 302 | 8.2 | 3.3 |
| 304A | 31.3 | 12.4 |
| 304B | 19.2 | 7.1 |
| 306 | 9.6 | 12.3 |

TABLE 2

Antenna Section Gap Dimensions

| Gap | x-dimension (mm) | y-dimension (mm) |
|---|---|---|
| 314 | 8.2 | 3.3 |
| 316A | 31.3 | 12.4 |
| 318 | 19.2 | 7.1 |
| 320 | 9.6 | 12.3 |

Figure 4A:
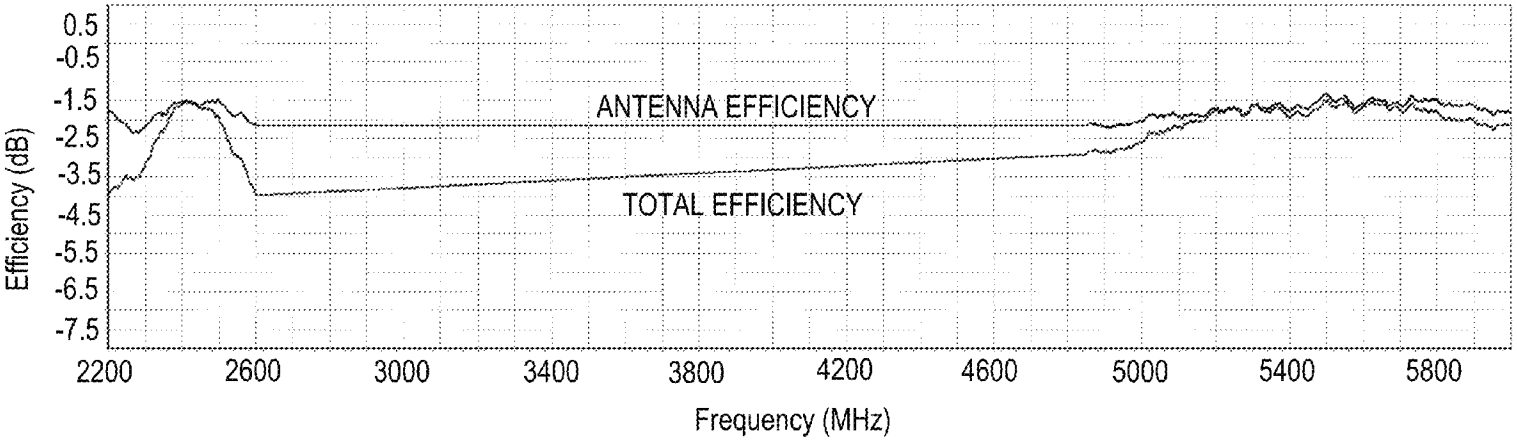
FIGS. 4A-4B are graphs of antenna radiation and total radiation efficiency, and reflection coefficient as a function of frequency.
Figure 4B:
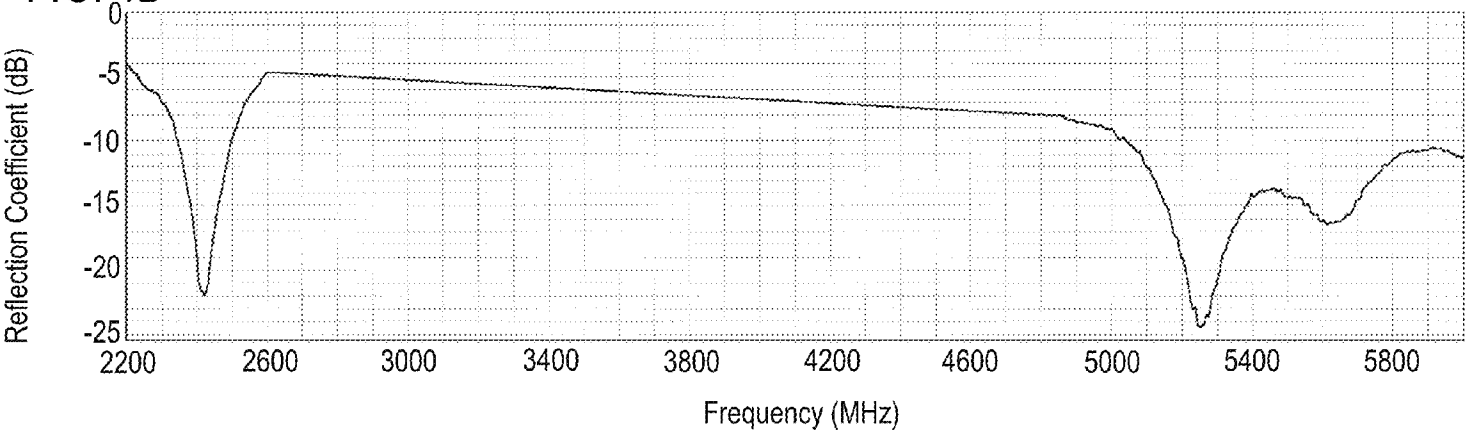

Antenna performance of an antenna similar to that of FIG. 3 is shown in FIGS. 4A-5B. FIGS. 4A-4B contain graphs of antenna and total efficiency and reflection coefficient as a function of frequency. The reflection coefficient has a reflection coefficient minimum in the second frequency band near 2.4 GHz. In the first frequency band, the reflection coefficient has minima at 5.25 GHz and 5.62 GHz. Over the frequency band from about 5.2 GHz to 5.7 GHz, the reflection coefficient of the antenna is reduced. This reduction is associated with acceptable antenna performance in the first frequency band.

Figure 5A:
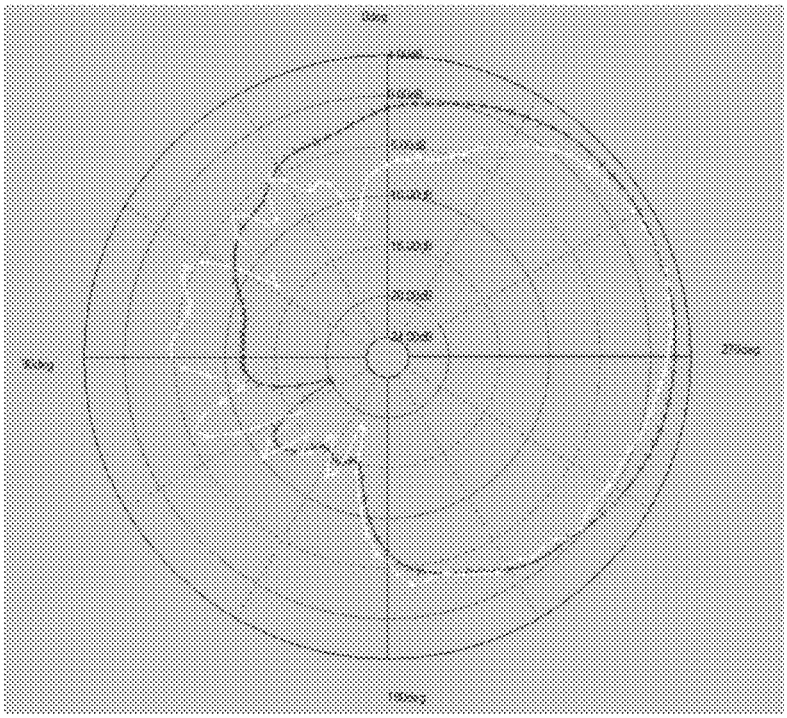
FIGS. 5A-5B are graphs showing radiation directionality for the dual band antenna of FIG. 3.
Figure 5B:
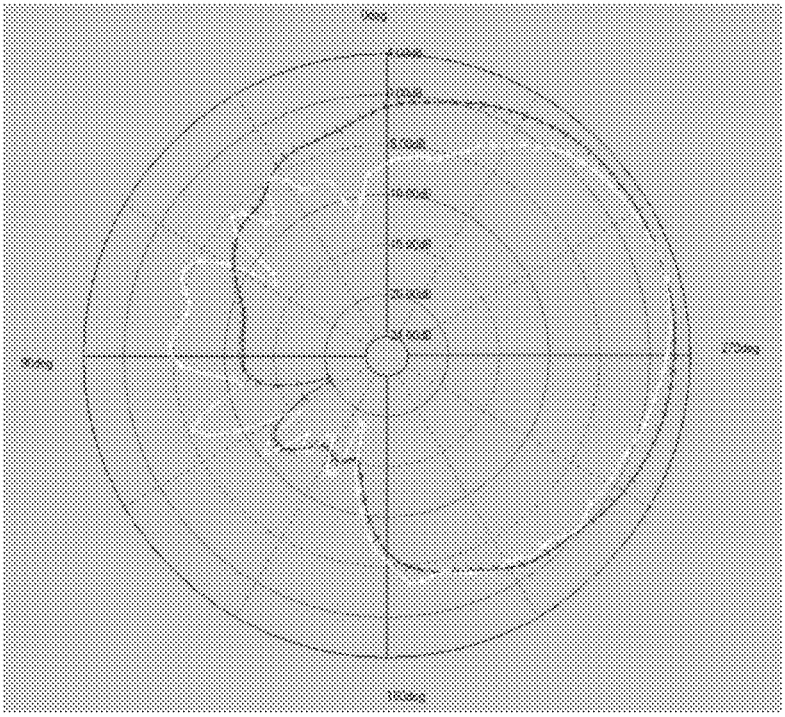

FIGS. 5A-5B illustrate antenna radiation patterns of an antenna similar to that of FIG. 3 at 2.440 GHz and 5.400 GHz. FIG. 5A shows radiated power as a function of angle from a normal to the antenna in a yz-plane approximately centered on the antenna. FIG. 5B is similar, but shows radiated power as a function of angle from the normal to the antenna in an xz-plane approximately centered on the antenna. As shown in FIGS. 5A-5B, the radiation pattern is directional, permitting radiated power to be directed to anticipated user locations, and not broadcast to locations at which user requests for access are deemed unlikely.

Figure 6:
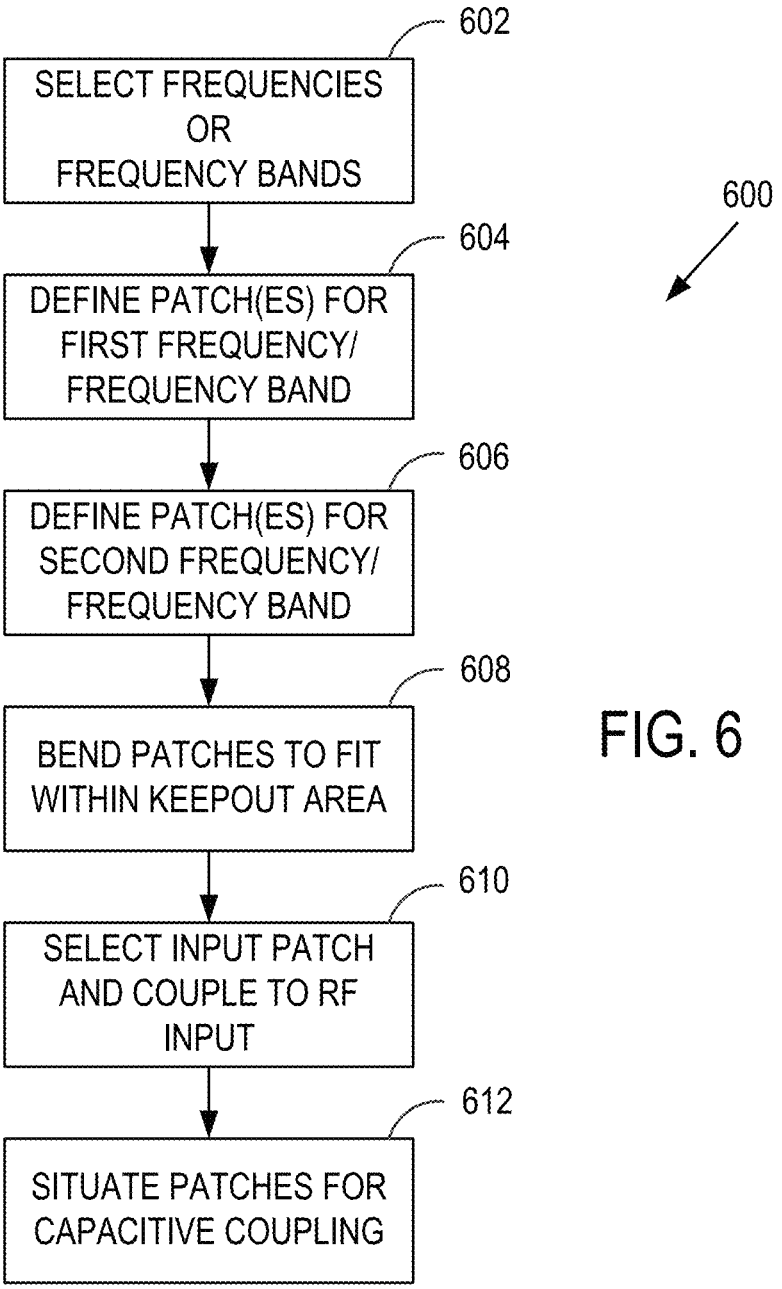
FIG. 6 is a representative method of selecting an antenna.

A representative method 600 of configuring an antenna is illustrated in FIG. 6. At 602, frequencies or frequency bands of interest are selected. At 604, one or more conductive patches are defined to be applied to a substrate for a first frequency band. The patches can be square, rectangular, L-shaped, U-shaped, S-shaped, or other shapes with continuous or discontinuously varying edges. Patch dimensions can be selected to be about ¼ or ½ wavelength (or even integer multiples thereof) in the first frequency band, and dimensions of multiple patches can be selected to improve antenna performance throughout the first frequency band. At 606, patches are defined for a second frequency or frequency band. At 608, one or more patch shapes are bent, folder, or otherwise modified so that the combined patches can be accommodated in a selected substrate area. At 610, a patch is selected as an input patch, and a transmission line such as a stripline or coaxial cable is configured to contact the selected patch. At 612, the patches are situated on the substrate so as to form patch or microstrip patch radiators. A preferred radiation direction can be selected and the substrate (with patches) oriented to preferentially radiate in the preferred direction.

Figure 7:
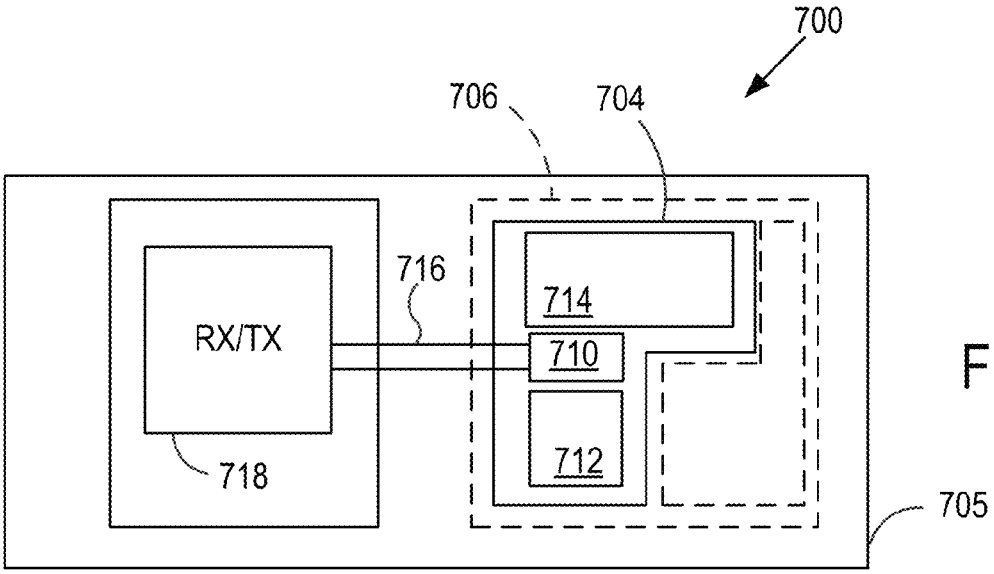
FIG. 7 illustrates a portion of a wireless network device that includes a dual band antenna.

A portion of a representative wireless communication device 702 such as a router, wireless access point, game console, or media player is illustrated in FIG. 7. An antenna 704 is defined in a keepout area 706 of a substrate 705 and includes first, second, and third antenna sections that include first, second, and third conductive patches 710, 712, 714, respectively. The first conductive patch 710 is coupled to a transmission line 716 that is in communication with a receiver/transmitter circuit 718 defined in a circuit area 720. The conductive patches 710, 712 of the first and second antenna sections are configured to operate in a first frequency band (typically having ¼ wavelength effective lengths at different frequencies in the first frequency band) and the conductive patch 714 of the third antenna section is configured to operate in a second frequency band. The conductive patch 714 can be bent or folded for compactness. Other conductive patches can be bent or folded as well. Because the second frequency band is at a lower frequency that the first frequency band, in typical applications the conductive patch 714 is generally the largest conductive patch so that bending or folding this patch is more effective in reducing antenna area. The conductive patches 712, 714 are situated to be capacitively coupled to the patch 710. The receiver/transmitter circuit 718 is in communication with signal and data processing circuitry and other processing hardware, but these are not shown in FIG. 7.

Figure 8:
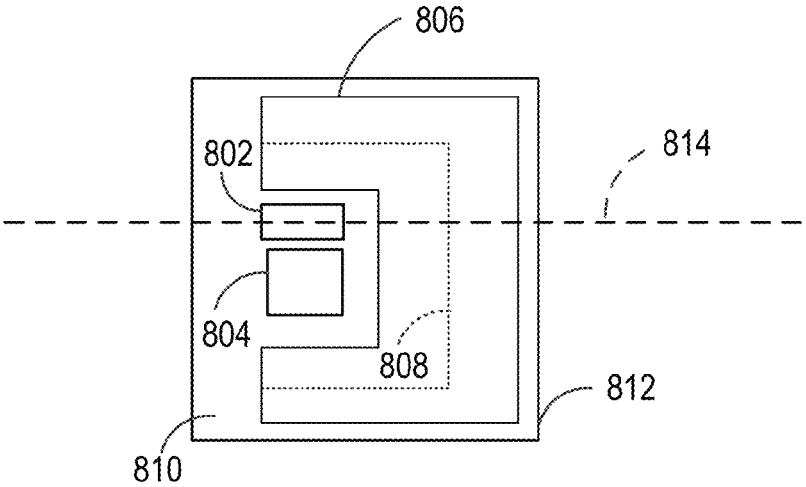
FIG. 8 illustrates a dual band antenna having a U-shaped antenna section.

FIG. 8 is a schematic diagram of an antenna assembly 800 that includes antenna sections 802, 804, 806 that are defined on a surface 810 of a substrate 812 and form respective planar monopole/patch antennas. The antenna section 806 is U-shaped and extends across a central longitudinal axis 814 of the antenna section 802. An effective length of the antenna section 816 is based on a folded section axis 808.

Figure 9:
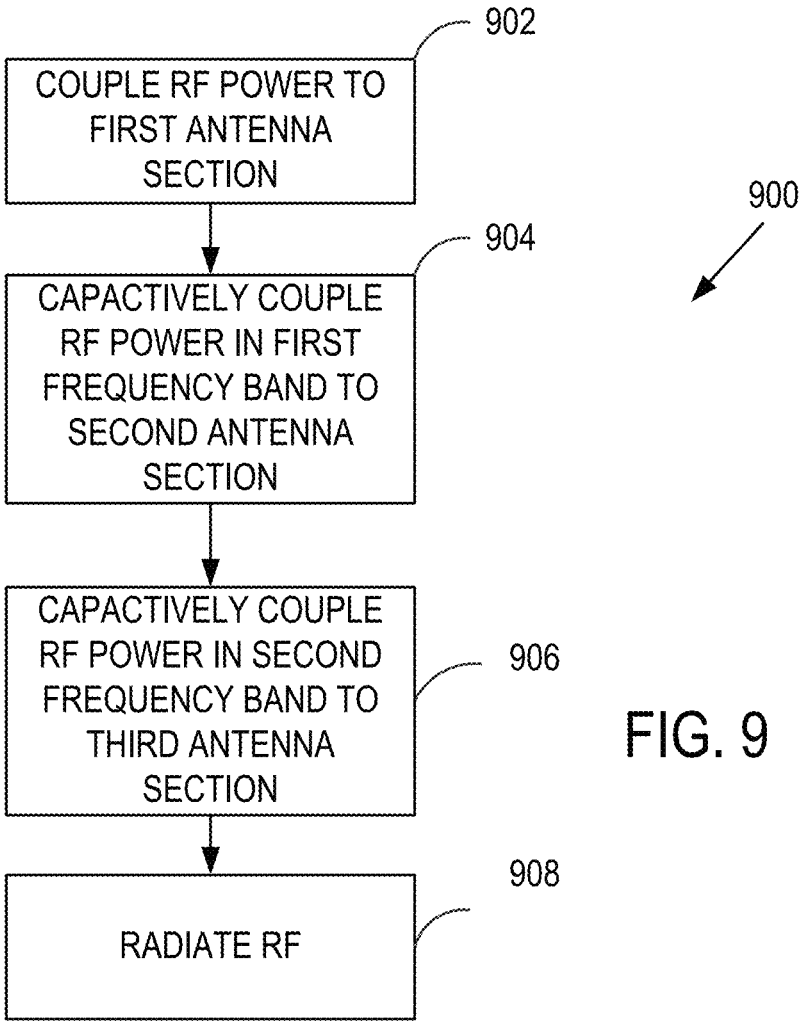
FIG. 9 is a block diagram of a representative method of transmitting radiofrequency signals.

FIG. 9 is a block diagram of a representative method 900 of radiating RF power. A similar method, but in a reverse order, is used for RF power reception. At 902, RF power in first and second frequency bands is coupled to a first antenna section via an electrical conductor such as a transmission line. At 904, RF power in the first frequency band (perhaps along with some RF power in the second frequency band) is capacitively coupled to a second antenna section. At 906, RF power in the second frequency band (perhaps along with some RF power in the first frequency band) is capacitively coupled to a third antenna section. At 908, RF power in both frequency bands is radiated. The first and second antenna sections are generally configured to provide a broader frequency response than that available with a single antenna section and multiple sections can be used to provide suitable bandwidth. Capacitive coupling can be used between any two or more sections as convenient.

In other examples, antennas are defined on curved substrate surfaces such as cylindrical surfaces. While antennas are conveniently defined on exterior surfaces of substrates, multilayer or other substrates can be used so that antenna conductors are internal. For directional antennas, an antenna substrate can be configured to permit angular adjustment so that angles of peak antenna gain can be directed to include anticipated user or user hardware locations. For example, with a game console mounted above user eye level, a directional antenna may be tiltable.

Figure 10:
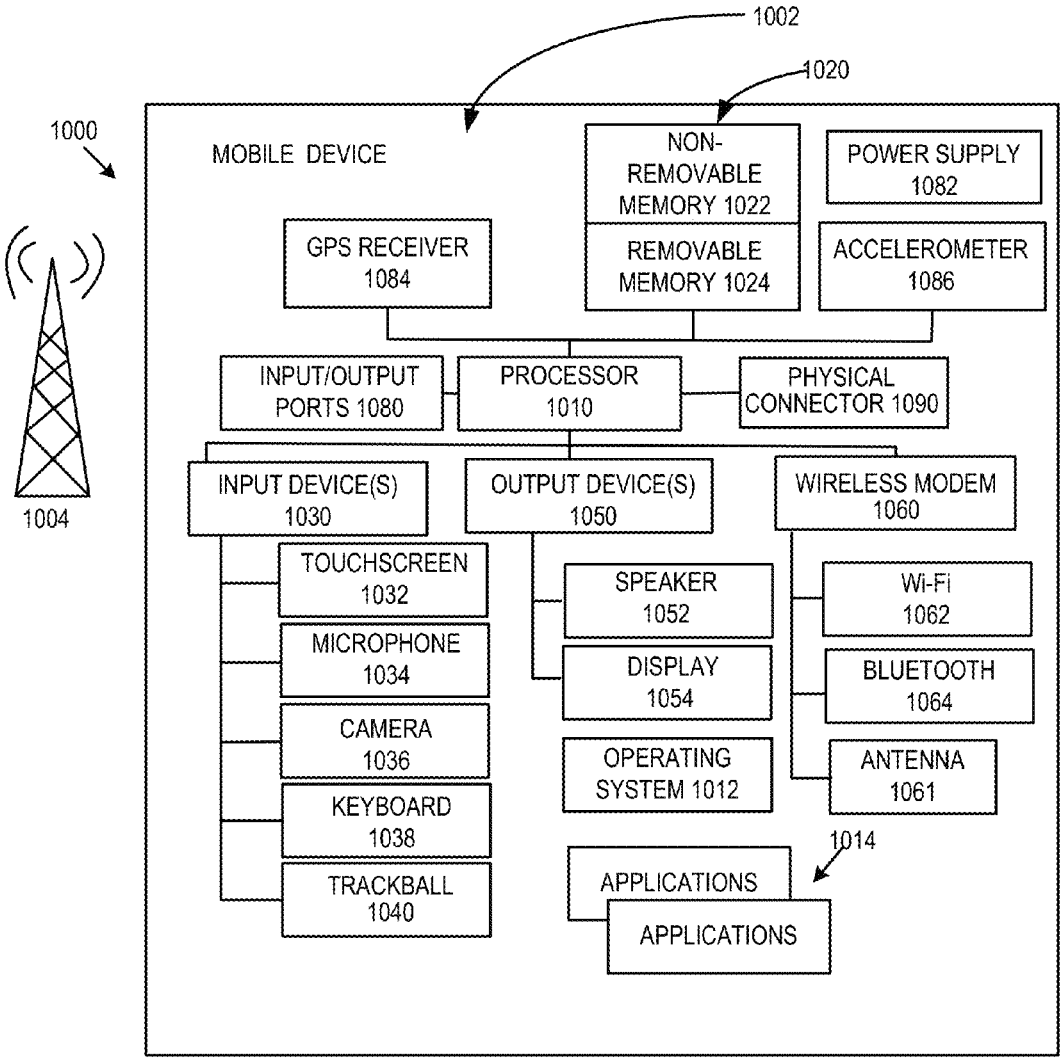
FIG. 10 is a block diagram of a representative mobile device.

The disclosed antennas can also be used in various other devices, such as mobile devices. FIG. 10 is a system diagram depicting an exemplary mobile device 1000 including a variety of optional hardware and software components, shown generally at 1002. Any components 1002 in the mobile device can communicate with any other component, although not all connections are shown, for ease of illustration. The mobile device can be any of a variety of computing devices (e.g., cell phone, smartphone, handheld computer, Personal Digital Assistant (PDA), etc.) and can allow wireless two-way communications with one or more mobile communications networks 1004, such as a cellular or satellite network.

The illustrated mobile device 1000 can include a controller or processor 1010 (e.g., signal processor, microprocessor, ASIC, or other control and processing logic circuitry) for performing such tasks as signal coding, data processing, input/output processing, power control, and/or other functions. An operating system 1012 can control the allocation and usage of the components 1002 and support for one or more application programs 1014. The application programs can include common mobile computing applications (e.g., email applications, calendars, contact managers, web browsers, messaging applications), or any other computing application.

The illustrated mobile device 1000 can include memory 1020. Memory 1020 can include non-removable memory 1022 and/or removable memory 1024. The non-removable memory 1022 can include RAM, ROM, flash memory, a hard disk, or other well-known memory storage technologies. The removable memory 1024 can include flash memory or a Subscriber Identity Module (SIM) card, which is well known in GSM communication systems, or other well-known memory storage technologies, such as "smart cards." The memory 1020 can be used for storing data and/or code for running the operating system 1012 and the applications 1014. Example data can include web pages, text, images, sound files, video data, or other data sets to be sent to and/or received from one or more network servers or other devices via one or more wired or wireless networks. The memory 1020 can be used to store a subscriber identifier, such as an International Mobile Subscriber Identity (IMSI), and an equipment identifier, such as an International Mobile Equipment Identifier (IMEI). Such identifiers can be transmitted to a network server to identify users and equipment.

The mobile device 100 can support one or more input devices 1030, such as a touchscreen 1032, microphone 1034, camera 1036, physical keyboard 1038 and/or trackball 1040 and one or more output devices 1050, such as a speaker 1052 and a display 1054. Other possible output devices (not shown) can include piezoelectric or other haptic output devices. Some devices can serve more than one input/output function. For example, touchscreen 1032 and display 1054 can be combined in a single input/output device. The input devices 1030 can include a Natural User Interface (NUI). An NUI is any interface technology that enables a user to interact with a device in a "natural" manner, free from artificial constraints imposed by input devices such as mice, keyboards, remote controls, and the like. Examples of NUI methods include those relying on speech recognition, touch and stylus recognition, gesture recognition both on screen and adjacent to the screen, air gestures, head and eye tracking, voice and speech, vision, touch, gestures, and machine intelligence. Other examples of a NUI include motion gesture detection using accelerometers/gyroscopes, facial recognition, 3D displays, head, eye, and gaze tracking, immersive augmented reality and virtual reality systems, all of which provide a more natural interface, as well as technologies for sensing brain activity using electric field sensing electrodes (EEG and related methods). Thus, in one specific example, the operating system 1012 or applications 1014 can comprise speech-recognition software as part of a voice user interface that allows a user to operate the device 1000 via voice commands. Further, the device 1000 can comprise input devices and software that allows for user interaction via a user's spatial gestures, such as detecting and interpreting gestures to provide input to a gaming application.

A wireless modem 1060 can be coupled to an antenna 1061 such as those shown above and can support two-way communications between the processor 1010 and external devices, as is well understood in the art. The modem 1060 is shown generically and can include a cellular modem for communicating with the mobile communication network 1004 and/or other radio-based modems (e.g., Bluetooth 1064 or Wi-Fi 1062). The wireless modem 1060 is typically configured for communication with one or more cellular networks, such as a GSM network for data and voice communications within a single cellular network, between cellular networks, or between the mobile device and a public switched telephone network (PSTN).

The mobile device can further include at least one input/output port 1080, a power supply 1082, a satellite navigation system receiver 1084, such as a Global Positioning System (GPS) receiver, an accelerometer 1086, and/or a physical connector 1090, which can be a USB port, IEEE 1394 (FireWire) port, and/or RS-232 port. The illustrated components 1002 are not required or all-inclusive, as any components can be deleted and other components can be added.

In view of the many possible embodiments to which the principles of the disclosed technology may be applied, it should be recognized that the illustrated embodiments are only preferred examples and should not be taken as limiting the scope of the disclosure. We claim all that comes within the scope and spirit of the appended claims.

We claim:

1. A dual band antenna, comprising:

a planar dielectric substrate having a first surface and a second surface opposite the first surface;

a conductive layer situated on the second surface of the planar dielectric substrate, the conductive layer defining a conductive ground plane and a nonconductive keepout area;

first, second, and third radiating conductors defined on a first surface of the planar dielectric substrate in an antenna area that is opposite the nonconductive keepout area, the first, second, and third radiating conductors without direct electrical connection to the conductive ground plane, wherein the second and the third radiating conductors are spaced apart from the first radiating conductor and are capacitively coupled to the first radiating conductor without conductive coupling, wherein the first radiating conductor is a conductive rectangle; and a transmitter feed line in electrical contact with the first radiating conductor and configured to communicate a radio frequency electrical signal, wherein the first radiating conductor is selected based on a quarter wavelength at a first frequency in a first frequency band, the second radiating conductor is selected based on a half wavelength at a frequency in a second frequency band different from the first frequency band, the third radiating conductor is selected based on a half wavelength at a second frequency in the first frequency band, and an effective length of the first radiating conductor corresponds to the quarter wavelength at the first frequency.

2. The dual band antenna of claim 1, wherein the second radiating conductor consists of a conductive area that is a rectangle or is defined by two connected rectangles that form an L-shape and an effective length of the second radiating conductor corresponds to the half wavelength at the frequency in the second frequency band.

3. The dual band antenna of claim 1, wherein the third radiating conductor consists of a conductive area that is a rectangle or is defined by two connected rectangles that form an L-shape and an effective length of the third radiating conductor corresponds to the half wavelength at the second frequency in the first frequency band.

4. The dual band antenna of claim 1, wherein the first frequency and the second frequency in the first frequency band are different frequencies.

5. The dual band antenna of claim 1, wherein the second radiating conductor is defined by two connected rectangles that form an L-shape and has an effective length that corresponds to the half wavelength at the frequency in the second frequency band.

6. The dual band antenna of claim 1, wherein the first, second and third radiating conductors are configured to preferentially radiate RF power away from the second surface of the substrate in response to an applied RF signal.

7. The dual band antenna of claim 1, wherein the second radiating conductor is defined by two connected rectangles that form an L-shape and has an effective length that corresponds to the half wavelength at the frequency in the second frequency band and extends across a central lengthwise axis of the first radiating conductor, and wherein the first frequency band is at about 5-6 GHz and the second frequency band is at about 2-3 GHz.

8. A method, comprising:

receiving RF power in first and second frequency bands at a first planar antenna section lacking a conductive path to a ground plane and configured to radiate RF power in the first frequency band, wherein the first planar antenna section has an effective length corresponding to a quarter wavelength at a first frequency in the first frequency band, wherein the first planar antenna section is a conductive rectangle;

capacitively coupling the RF power in at least the first frequency band from the first planar antenna section to a second planar antenna section lacking a conductive path to a ground plane and configured to radiate RF power in the first frequency band, wherein the second planar antenna section has an effective length corresponding to a half wavelength at a second frequency in the first frequency band, wherein the second planar antenna section is defined as a conductive rectangle or by two connected conductive rectangles that form an L-shape, and capacitively coupling the RF power in at least the second frequency band from the first planar antenna section to a third planar antenna section lacking a conductive path to a ground plane and configured to radiate RF power in the second frequency band, wherein the third planar antenna section has an effective length corresponding to a half wavelength in the second frequency band, wherein the third planar antenna section is defined as a conductive rectangle or by two connected conductive rectangles that form an L-shape, wherein the first, second, and third planar antenna sections are situated on a first surface of a substrate opposite a keepout area defined in a conductive layer on a second surface of the substrate.

9. The method of claim 8, wherein the first and second planar antenna sections have different peak radiation frequencies in the first frequency band.

10. The method of claim 9, wherein the first frequency band is at about 5-6 GHz and the second frequency band is at about 2-3 GHz.

11. The method of claim 8, wherein the second and third planar antenna sections have effective lengths corresponding to integer multiples of ½ wavelength in the associated frequency bands.

12. A wireless networking apparatus, comprising:

a dual band antenna;

a transceiver configured to receive RF signals from the antenna and couple RF signals to the antenna, wherein the antenna comprises first, second, and third patch antenna sections defined by respective planar conductive patches situated on a first surface of a planar substrate opposite a nonconductive keepout area defined in a ground conductive layer on a second surface of the planar substrate, wherein the second and third patch antenna sections are capacitively coupled to the first patch antenna section without conductive electrical connection to the first patch antenna section and to ground, and the first patch antenna section is conductively coupled to the transceiver, wherein the first and second patch antenna sections are configured for wireless communication in a first frequency band, wherein one of the first and second patch antenna sections has a length associated with a quarter wavelength at a frequency in the first frequency band, and the third patch antenna section is an L-shaped conductive patch having an effective length associated with a second frequency band, wherein the first frequency band is at about 5-6 GHz and the second frequency band is at about 2-3 GHz, and further wherein the first patch antenna section is a conductive rectangle, the second patch antenna section is defined as a conductive rectangle or as first and second conductive rectangles that form an L-shape, and the third patch antenna section is defined by first and second conductive rectangles that form the L-shape.

13. The apparatus of claim 12 wherein the conductive patches of the first, second, and third patch antenna sections are configured to transmit and receive radiation preferentially from a selected side of the substrate.

14. The apparatus of claim 13, wherein the conductive patches of the first and second patch antenna sections have effective lengths corresponding to ¼ wavelength for RF signals in the first frequency band, and the effective length of the third antenna patch section corresponds to ½ wavelength for RF signals in the second frequency band.

* * * * *